United States Patent [19]

Ward et al.

[11] Patent Number: 4,649,808

[45] Date of Patent: Mar. 17, 1987

[54] FIREPLACE DAMPER ASSEMBLY

[76] Inventors: Robert Ward, 10835 Dryden Ave., Cupertino, Calif. 95014; John Newman, 10570 Stratford Ct., Monte Sereno, Calif. 95030

[21] Appl. No.: 816,397

[22] Filed: Jan. 6, 1986

[51] Int. Cl.[4] ..... F23L 17/02

[52] U.S. Cl. ..... 98/59; 98/68; 126/288

[58] Field of Search ..... 126/288, 286, 285 R, 126/292, 290; 98/59, 68, 78, 71, 116; 110/119, 162

[56] References Cited

U.S. PATENT DOCUMENTS

| | | | |
|---|---|---|---|
| 1,271,333 | 7/1918 | Lind et al. | 98/68 |
| 1,720,789 | 7/1929 | Heusser | 98/59 |
| 1,865,295 | 6/1932 | Arper | 98/59 |
| 2,171,883 | 9/1939 | McDerment | 98/68 |
| 2,295,839 | 9/1942 | Gigsby | 98/59 |
| 3,012,495 | 12/1961 | Miller | 98/116 |
| 4,554,863 | 11/1985 | Dalsin | 98/59 |

FOREIGN PATENT DOCUMENTS

| | | | |
|---|---|---|---|
| 706 | of 1878 | United Kingdom | 98/68 |
| 10320 | of 1889 | United Kingdom | 98/68 |

*Primary Examiner*—James C. Yeung
*Attorney, Agent, or Firm*—Bachman & LaPointe

[57] ABSTRACT

A damper assembly for sealing a vertical fireplace exhaust including a vertical duct having an outlet communicating with the atmosphere for exhaust of fireplace fumes, mounting means mounted on said vertical duct outlet, a damper downstream of said vertical duct outlet operative to block and open said vertical duct outlet and means to open and close said damper. Easily added improvements include a spark screen assembly downstream of said damper and communicating with said vertical duct outlet, electrical actuation of said damper, automatic control of said actuation by temperature and/or smoke detection means, a fan to provide draft assist, and/or a wind protection hood to provide a better draft.

14 Claims, 8 Drawing Figures

FIREPLACE DAMPER ASSEMBLY

BACKGROUND OF THE INVENTION

The present invention deals with a damper assembly for sealing a vertical fireplace exhaust.

Conventional fireplace construction utilizes a damper in the dwelling place adjacent the fire box and permits the vertical duct or chimney outlet to remain open to the atmosphere. It would be desirable to provide a damper assembly which can be used in addition to or in place of present construction and which can be mounted adjacent the vertical duct outlet. Such an assembly would result in fuel savings as by further insulating the fire box, should be versatile to adapt same for a variety of functions and should be operable either manually or automatically from within the dwelling place.

With the increase in the cost of fuel, particularly petroleum-based fuel, as well as the uncertainty of its uninterrupted availability from foreign sources, there is increasing concern for obtaining the maximum possible efficiency from residential heating systems. In the past, approximately 25% of the heat produced when the furnace was running escaped up the chimney rather than being transferred to the house. In addition, when the furnace is turned off, drafts continue to pull warm air up the chimney and out of the house. This loss due to chimney draft while the furnace is off accounts for an additional loss of the heat produced.

Most fireplaces are constructed with a manually controlled damper located at the top of the firebox. Such dampers tend to warp with age and the sealing edge of the damper and corresponding flue surfaces become encrusted with varying thicknesses of deposits making a positive seal impossible. In addition, the damper actuator is inconveniently located and may be inadvertently left open for long periods of time.

It would be desirable to develop an improved damper assembly which minimizes these problems.

Accordingly, it is an object of the present invention to provide an improved damper assembly for sealing a vertical fireplace exhaust.

It is a further object of the present invention to provide an improved damper assembly as aforesaid which is easy to use, can readily be added to existing vertical fireplace exhausts, is safe, efficient, versatile and easy to operate.

Further objects and advantages of the present invention will appear hereinbelow.

SUMMARY OF THE INVENTION

In accordance with the present invention, it has now been found that the foregoing objects and advantages can be readily obtained. The damper assembly of the present invention comprises: a vertical duct having an outlet communicating with the atmosphere for exhaust of fireplace fumes; mounting means mounted on said vertical duct outlet preferably providing the vertical duct outlet with a round orifice; a damper downstream of said vertical duct outlet mounted on said mounting means operative to block and open the vertical duct outlet and means to open and close said damper. Preferably a draft assist means is mounted on said mounting means upstream of said damper including an exhaust fan positioned therein. Also, it is preferred to utilize a spark screen assembly downstream of said damper and communicating with said vertical duct outlet and a freely rotatable wind protection hood positioned on the spark screen assembly.

BRIEF DESCRIPTION OF THE DRAWINGS

The present invention will be more readily understandable from a consideration of the following illustrative, partly schematic drawings in which.

DETAILED DESCRIPTION

Figure 2:
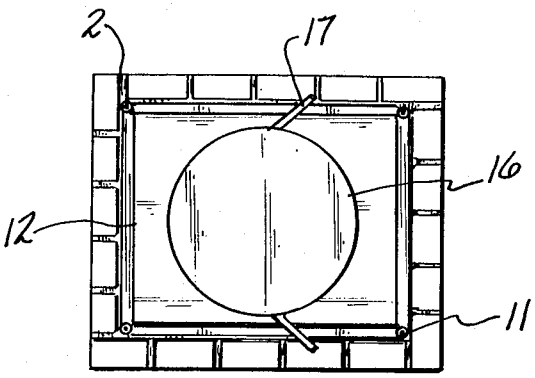
FIG. 2 is a top view of the assembly of FIG. 1.

The features of the present invention include an external damper, which can be retrofitted to almost any fireplace chimney to seal it from the outside air when the fireplace is not in use, and means to control the damper. The damper may be manually actuated or actuated by a manually controlled low voltage motor. If desired, one may employ an automatic control for the motor using independent temperature and smoke detection sensors or redundant temperature or smoke detection sensors. In addition, a spark screen can be added for greater safety and an exhaust fan and/or a wind protection hood can be provided to assist the draft.

The external damper assembly includes a mounting means which attaches to the top of the chimney and provides mechanical support for the external damper and preferably converts oblong or oval chimney exits to a round orifice at the top of the mounting means. If a fan assisted draft is desired, a module to provide this function fits into the top of, and extends above, the mounting means. The external damper module fastens to the mounting means or to the draft assist module.

The features of the present invention also may include:

(1) a safety spark screen with a solid metal top surface;

(2) a bi-directional, low voltage drive motor with a bracket for an optional, directional wind-hood;

(3) a weighted external damper suspended by a cable from the drive pulley attached to the drive motor.

The damper may be pivoted or rotated to uncover the exit orifice. In the preferred configuration it is raised or lowered preferably by a drive motor as controlled by a control box located within the dwelling. The damper is covered on the bottom with a flexible insulating material and in the closed position rests on the exit orifice providing a positive seal.

An optional, directional wind-hood can be fitted into a bracket at the center of the top of the preferred spark screen, or a cover, which encloses the top of the preferred spark screen to protect the drive motor, can be installed. The optional, directional wind-hood, if installed, is free to rotate about a pivot and will automatically (aerodynamically) rotate so the open side is away from the wind.

A control box may be provided containing circuitry that provides low voltage for directional drive to the damper drive motor and to drive the draft assist fan if a drive assist fan is used. Open or close drive would continue until enough time had elapsed to assure the desired motion is completed or until the open or closed position in the external damper assembly is detected as by limit switch, change in motor drive characteristics or position measurement.

The present invention may if desired readily be used with an automatic close feature. If this feature is used a thermocouple may be installed in the firebox to sense fireplace temperature and a second thermocouple may be mounted in the control box to sense ambient temperature. A command to close the damper will not be executed until the difference between fireplace and ambient temperatures is below an acceptable minimum. If, after automatically closing, either a large temperature difference develops or a positive output from the smoke detector is detected, the control box automatically raises the external damper.

A smoke detector may be used as an integral part of the control logic if an automatic close feature is utilized. The smoke detector may be separately powered from the control box by a battery and provides both an independent back-up to the temperature detection system and an audible alarm if smoke is detected continuously for even a short period of time. Automatic open and close may continue as long as the states of the temperature and/or smoke detectors so dictate. If heat or smoke develop after the damper automatically closes, the damper will automatically reopen; if the temperature difference returns to low and/or the smoke diminishes, the damper automatically recloses.

Figure 3:
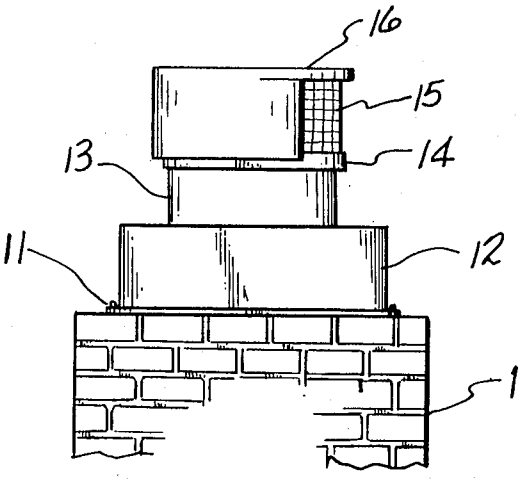
FIG. 3 is a side view of the assembly of FIG. 1.
Figure 1:
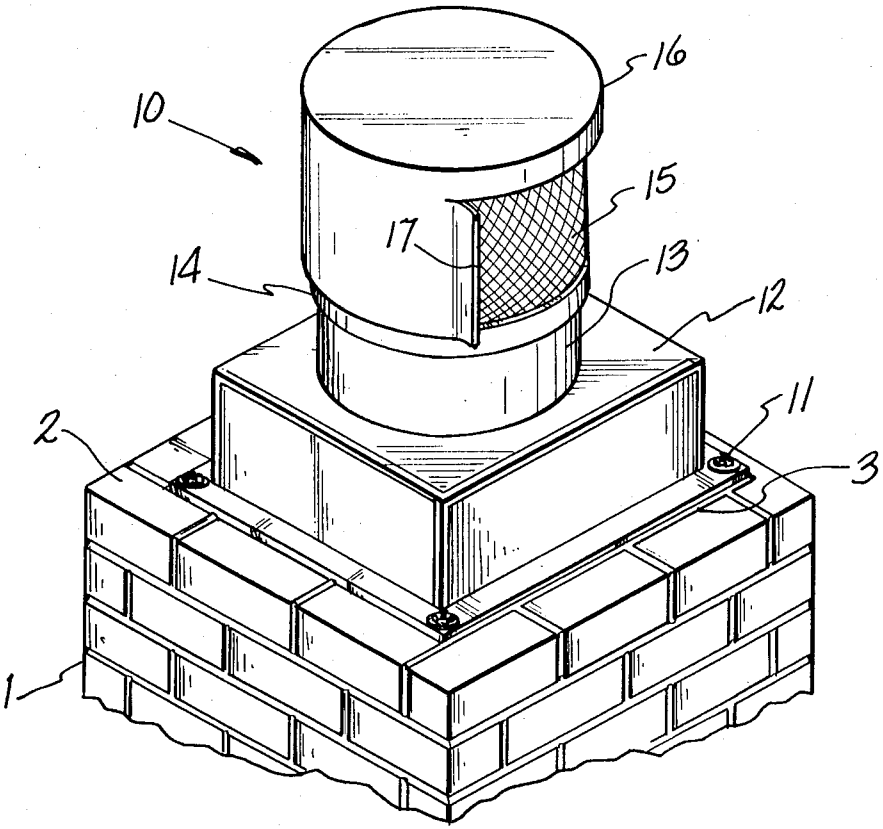
FIG. 1 is a perspective view of the damper assembly of the present invention mounted on a vertical fireplace exhaust including the preferred spark screen assembly, wind hood and draft assist means.

Specifically referring to the drawings, FIG. 1 shows a perspective view of the preferred damper assembly of the present invention installed on a chimney exit. Referring to FIGS. 1–3, vertical duct or chimney 1 is shown having a top 2 with a vertical duct outlet 3 communicating with the atmosphere for exhaust of fireplace fumes.

The damper assembly 10 in the preferred embodiment of the present invention is installed on chimney top 2 enclosing the chimney liner (not shown), as by bolts 11 and caulking (not shown). This provides an airtight transition from any shaped chimney liner to a round opening which may be of slightly greater area than any enclosed chimney liner.

The damper assembly 10 includes a mounting means 12 mounted on the chimney top 2, draft assist means 13 which is a preferred component mounted on mounting means 12, spark screen assembly 14 including preferred component spark screen 15 mounted on the draft assist means 13 if used and if not on the mounting means 12, and an optional wind protection hood 16 mounted on the spark screen assembly 14. As indicated hereinabove, hood 16 is free to rotate about a pivot in a manner which will be seen hereinafter and will automatically (aerodynamically) rotate so that the open side of the safety screen is away from the wind. For this purpose, hood 16 includes vanes or arms 17 extending radially from the hood to catch the wind.

The draft assist means 13, if installed, rests on top of the mounting means 12 and may project slightly into the mounting means. The spark screen assembly 14 with the spark screen installed provides safety by limiting the size of embers that can be ejected by the fire into the external environment and also provides a structure for mounting the damper, damper drive motor and hood.

Figure 4:
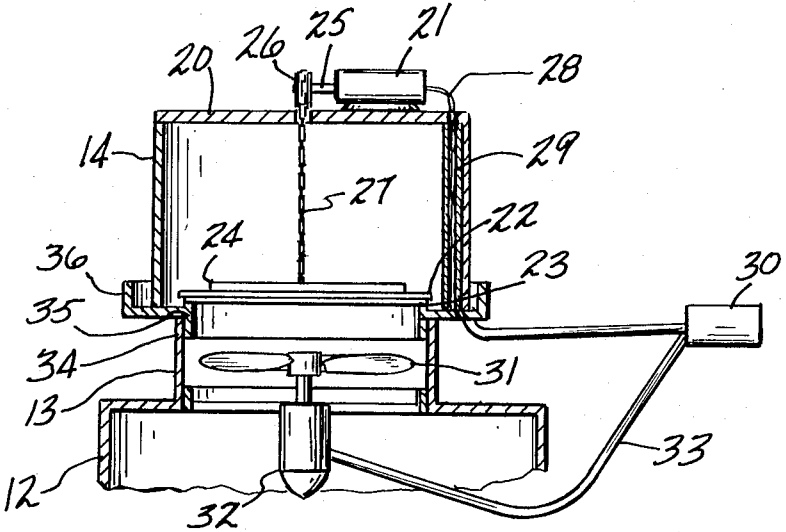
FIG. 4 is a sectional view of the assembly of FIG. 1 with the wind hood removed.
Figure 5:
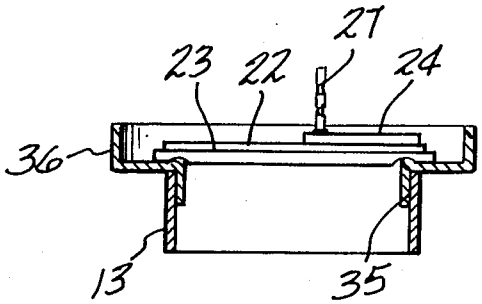
FIG. 5 is a detail view of the damper rotated 90° from FIG. 4.

FIG. 4 shows greater details of the components of the damper assembly of the preferred configuration of the present invention with the hood removed. Spark screen assembly 14 is provided with a solid roof 20, as of metal which serves to support the means 21 to open and close the damper 22. The means 21 to open and close the damper 22 may be a low voltage, bi-directional drive motor affixed to roof 20. If the wind protective hood were employed it would cover motor 21 and the spark screen assembly as shown in FIGS. 1–3. Damper 22 includes a flexible insulating material 23 covering the bottom of the damper to form a tight seal and metal plate or counterweight 24 which adds mass to the damper and keeps it from tilting as it is raised or lowered. As shown in FIG. 5, the actuating cable 27 is affixed to the damper 22 at a point offset from the geometric center of the damper since the hood if present must be pivoted from the geometric center of the top of the spark screen assembly.

Motor 21 is provided with shaft 25 which rotates pulley 26 which raises or lowers cable 27 running over pulley 26 and attached to damper 22 and therefore raises or lowers damper 22. Means may be provided to limit the travel of cable 27, as by providing pulley 26 with a lobed surface that actuates a limit switch closed or a limit switch opened to stop motor 21 once the damper 22 is fully closed as shown in FIGS. 4 and 5, or fully opened. Damper 22 is in the fully opened position (not shown) when it is raised nearly to screen roof 20.

As can be seen, the preferred embodiment of this invention is a damper (heavy, flat metal plate covered with a thin, flexible insulating material) lifted straight up from a narrow metal edge. This has several advantages namely: (1) there are no critical alignments; (2) a tight seal is easily provided which should be relatively unaffected by deposits or embers; (3) the travel of the cable is not critical; (4) virtually no impediment to airflow is present in the open position; and (5) the actuation is nearly fail-safe since the motor must be driven to either raise or lower the damper—the damper motor gearing will prevent the damper from dropping spontaneously even with power off.

Power in and limit logic signals out are carried in a multi-wire cable 28 through hollow tube 29 affixed to the inner surface of spark screen assembly 14. This protects the multi-wire cable 28 from the direct heat of escaping gases and from rubbing on the rotating windhood 16. Multi-wire cable 28 may terminate in a control box 30 situated inside the dwelling.

The draft assist means 13 which is preferably employed is located between spark screen assembly 14 and mounting means 12 as clearly shown in FIG. 4. The draft assist means 14 includes fan 31 mounted centrally therein with fan motor 32 and fan cable 33 connected to control box 30. Fan 31 provides draft assist where needed. Fan 31 is mounted in draft assist assembly 34 which is mounted on mounting means 12 and which includes inwardly extending lip 35 to provide an interfacing surface for engagement with damper insulating material 23 and outwardly extending flange 36 for attachment of the spark screen assembly. If desired flange 36 can be used as a bearing surface for the hood 16.

Figure 6:
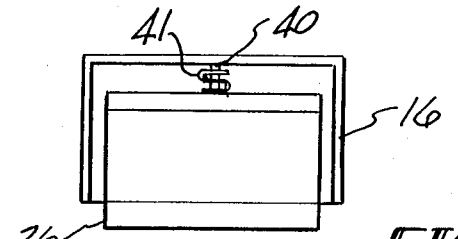
FIG. 6 is a detail of the wind hood installed on the spark screen assembly.
Figure 7:
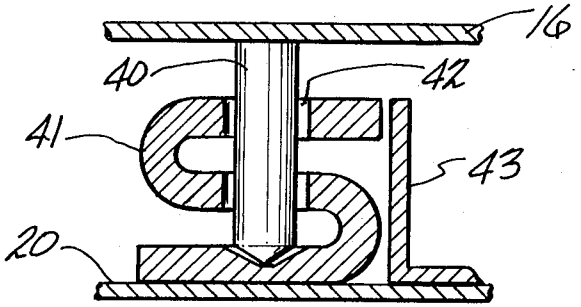
FIG. 7 is an enlarged detail of the wind hood mounting.

FIGS. 6 and 7 show details of the suspension of hood 16, or a top enclosure if the hood is not used. Hood 16 pivots on pivot pin 40 affixed to the hood at its upper end and resting in bracket 41 at its lower end and passing through bracket hole 42. Bracket 41 provides lateral support and a rotational bearing surface for the hood support pin 40. The bracket 41 is affixed to the solid screen top or roof 20 at its geometric center.

Figure 8:
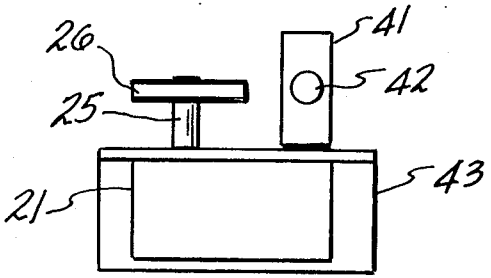
FIG. 8 is a top view of the spark screen assembly showing the relationship of the motor mount, wind hood and damper drive pulley.

FIG. 8 shows the relationship of bracket 41, bracket hole 42, damper motor 21, motor shaft 25 and motor pulley 26. Motor 21 is mounted on motor mount 43 which in turn is mounted on screen top 20.

Control for the damper and fan assisted draft (if used) is provided by control box 30 which is located within the dwelling. The control box may accept 110 volt AC power and use it directly or transform or convert it to low voltage motor drive power, and convert the 110 volts AC to DC as required to power the control logic and relays. Power for the smoke detector (if used) may be built into the control box when the automatic damper open-close feature is used. If desired, power for the automatic damper open-close feature may be provided by a separate battery independent of the control box, or also total battery controlled operation may be employed.

Naturally, the entire operation may be manually controlled if desired. In addition, automatic operation may readily be employed. A typical method of operation is as set forth below. When the control box is first powered on, the relays controlling the damper will be latched open and no drive will be applied to the damper motor. To open or close the damper, the proper, normally open push button switches would be activated to set the proper drive relays and drive will commence. Drive may be stopped when changes in the drive characteristics of the motor are detected, open or close limit switches are actuated by the opening or closing damper or damper motor or enough time elapses to assure completion of the desired motion. Completion of the desired motion would preferably result in an indicator light being set. Positive indication of open or close is maintained until another motion is commanded and completed.

If an automatic close option is utilized, a thermocouple may be installed in the fire box and a second thermocouple installed in the control box. If the fire box temperature drops to near ambient as measured by the thermocouples and/or if no smoke is detected, the drive motor will be commanded in the closed direction until closure is detected or assumed. Closure will result in lighting the flue closed indicator light in the control box.

If after the damper is closed a large temperature difference develops between the fire box and ambient, or if a smoke detector detects smoke, an open flue command is generated. Open flue continues until the flue open is detected or assumed, the flue open indicator light comes on, and drive stopped. This cycle continues until the fire is totally out resulting in a closed damper as indicated hereinabove.

If fan assisted draft and automatic flue close options are both utilized, the fan will always be turned off when the flue is closed. The fan will automatically be turned on if the fan is on originally and the flue is automatically opened.

Naturally all of the foregoing functions can be controlled by the control box and can be programmed for automatic operation or manual operation if desired. In addition, all control logic and detectors may be made redundant to assure no single point failures can result in unwanted actuation.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A damper assembly for sealing a vertical fireplace exhaust which comprises: a vertical duct having an outlet communicating with the atmosphere for exhaust of fireplace fumes; mounting means mounted on said vertical duct outlet; a damper downstream of said vertical duct outlet mounted on said mounting means operative to block and open said vertical duct outlet, said damper having a counterweight affixed thereto and a damper motor mounted above said mounting means and cable means engaging said damper motor and damper actuated by said damper motor operative to open and close said damper.

2. A damper assembly according to claim 1 including a spark screen mounting means including a spark screen mounted therein operative to limit the size of embers that can be ejected into the atmosphere downstream of said damper and communicating with said vertical duct outlet.

3. A damper assembly according to claim 2 including draft assist means mounted on said mounting means including an exhaust fan positioned therein.

4. A damper assembly according to claim 3 wherein said draft assist means is located upstream of said damper.

5. A damper assembly according to claim 3 including a control box for actuating the damper and the exhaust fan.

6. A damper assembly according to claim 2 including a wind protective hood positioned on said spark screen mounting means.

7. A damper assembly according to claim 6 wherein said spark screen mounting means has a solid top and said hood is mounted on said solid top at the geometric center thereof in a manner to be freely rotatable.

8. A damper assembly according to claim 7 wherein said hood includes radially extending vanes.

9. A damper assembly according to claim 2 including a counterweight affixed to the top of the damper at a point offset from the geometric center of the damper.

10. A damper assembly according to claim 1 wherein said mounting means provides the vertical duct outlet with a round orifice.

11. A damper assembly according to claim 1 including flexible insulating material covering the bottom of the damper.

12. A damper assembly according to claim 1 wherein said damper is a substantially flat plate operative to block said outlet and said means to open and close said damper is operative to move said damper straight up in relation to the vertical duct outlet.

13. A damper assembly for sealing a vertical fireplace exhaust which comprises: a vertical duct having an outlet communicating with the atmosphere for exhaust of fireplace fumes; mounting means mounted on said vertical duct outlet; a damper downstream of said vertical duct outlet mounted on said mounting means operative to block and open said vertical duct outlet and means to open and close said damper, a spark screen mounting means including a spark screen mounted therein operative to limit the size of embers that can be ejected into the atmosphere downstream of said damper and comunicating with said vertical duct outlet, draft assist means located upstream of said damper mounted on said mounting means including an exhaust fan positioned therein, wherein said exhaust fan is mounted in said draft assist means and wherein said draft assist means includes an inwardly extending lip for engagement with said damper and an outwardly extending flange for mounting said spark screen mounting means.

14. A damper assembly for sealing a vertical fireplace exhaust which comprises: a vertical duct having an outlet communicating with the atmosphere for exhaust of fireplace fumes; mounting means mounted on said vertical duct outlet; a damper downstream of said vertical duct outlet mounted on said mounting means operative to block and open said vertical duct outlet and means to open and close said damper, a spark screen mounting means including a spark screen mounted therein operative to limit the size of embers that can be ejected into the atmosphere downstream of said damper and communicating with said vertical duct outlet, a counterweight affixed to top of the damper at a point offset from the geometric center of the damper, wherein said means to open and close the damper includes a damper motor mounted on said spark screen mounting means having a rotatable pulley connected thereto and a pulley cable extending therefrom and connected to the counterweight at a point offset from the geometric center of the counterweight.

* * * * *